US012416416B1

(12) United States Patent
Olson et al.

(10) Patent No.: US 12,416,416 B1
(45) Date of Patent: Sep. 16, 2025

(54) WALL MOUNTED HVAC SYSTEM

(71) Applicant: Victory Climate Systems, LLC, Fort Worth, TX (US)

(72) Inventors: John Olson, Fort Worth, TX (US); George Western, Jacksonville, TX (US)

(73) Assignee: Victory Climate Systems, LLC, Fort Worth, TX (US)

( * ) Notice: Subject to any disclaimer, the term of this patent is extended or adjusted under 35 U.S.C. 154(b) by 110 days.

(21) Appl. No.: 18/358,382

(22) Filed: Jul. 25, 2023

Related U.S. Application Data

(60) Provisional application No. 63/391,910, filed on Jul. 25, 2022, provisional application No. 63/436,355, filed on Dec. 30, 2022.

(51) Int. Cl.
*F24F 1/0314* (2019.01)
*F24F 1/027* (2019.01)
*F24F 1/031* (2019.01)

(52) U.S. Cl.
CPC ..... *F24F 1/0314* (2019.02); *F24F 1/027* (2013.01); *F24F 1/031* (2019.02); *F24F 2221/17* (2013.01)

(58) Field of Classification Search
CPC ..... F24F 1/027; F24F 1/031; F24F 1/0314; F24F 2221/17; F25B 2400/07
See application file for complete search history.

(56) References Cited

U.S. PATENT DOCUMENTS

2002/0026797 A1* 3/2002 Sundhar ..... B60H 1/005 62/235.1
2008/0307820 A1* 12/2008 Ingram ..... B60H 1/00042 62/426
2018/0326813 A1* 11/2018 Ganiere ..... B60R 16/03
2019/0168576 A1* 6/2019 Larson ..... B60H 1/00885

* cited by examiner

*Primary Examiner* — Joseph F Trpisovsky
(74) *Attorney, Agent, or Firm* — James E. Walton

(57) ABSTRACT

A wall mounted HVAC system includes a housing having an internal cosmetic panel, a holder supporting an air filter, and at least one external vent, the wall mounted HVAC system, further having a 48 Volt DC electric compressor, an evaporator coil, a condenser coil, a 48 Volt DC dual blower system, an over-temperature protection system, and a thermostatic expansion valve. The wall mounted HVAC system is configured to attach to a building structure and may be used when the building structure does not have readily available power from a generator or electrical grid.

1 Claim, 13 Drawing Sheets

WALL MOUNTED HVAC SYSTEM

This application claims the benefit of U.S. Provisional Patent Application No. 63/391,910, filed 25 Jul. 2022, titled "Wall Mounted Climate Control System," and U.S. Provisional Patent Application No. 63/436,355, filed 30 Dec. 2022, titled "Wall Mounted HVAC System," both of which are incorporated herein for all purposes.

BACKGROUND

1. Field of the Invention

The present application relates generally to wall mounted climate control systems.

2. Description of Related Art

There are many different types of air conditioning systems in the market today. Some of these systems are designed to be mounted on the wall of a structure to provide air conditioning to the interior of the structure. However, relatively few of these systems are designed to run on DC power, and most are of those are underpowered and inefficient.

Although great strides have been made in the area of wall mounted climate control systems, considerable shortcomings remain.

DESCRIPTION OF THE DRAWINGS

The novel features believed characteristic of the application are set forth herein. However, the application itself, as well as a preferred mode of use, and further objectives and advantages thereof, will best be understood by reference to the following detailed description when read in conjunction with the accompanying drawings, wherein.

Figure 1:
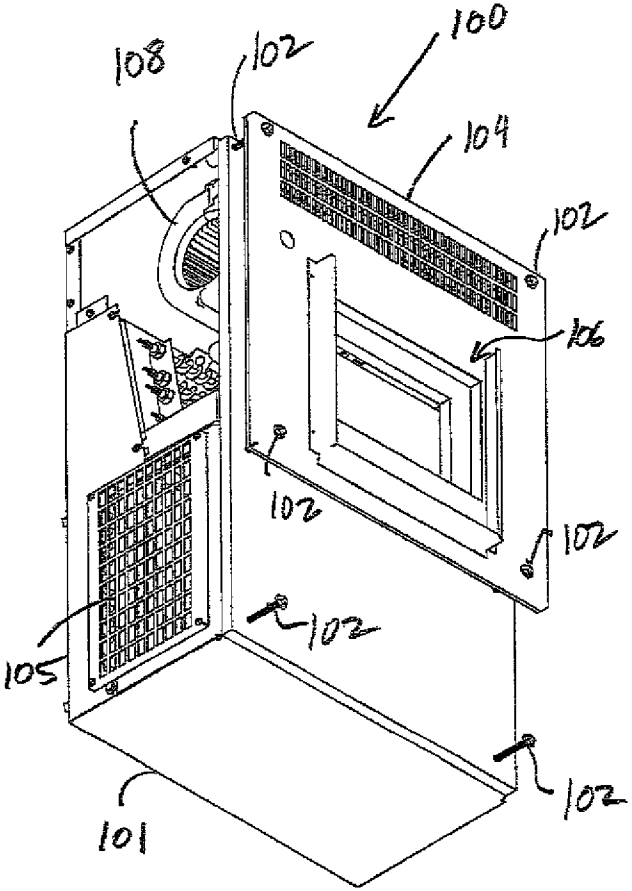
FIG. 1 is a rear perspective view of a wall mounted climate control system according to one embodiment of the present application.
Figure 4:
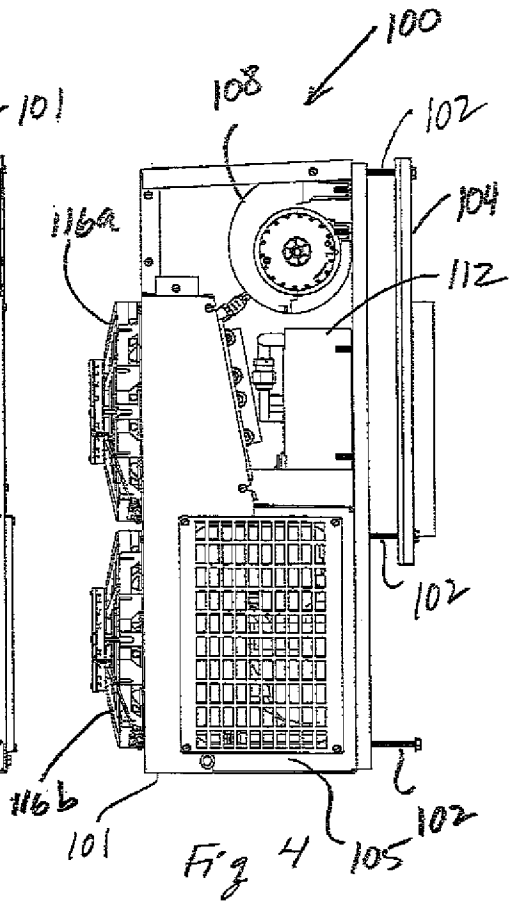
FIG. 4 is a right side view of the wall mounted climate control system of FIG. 1.
Figure 3:
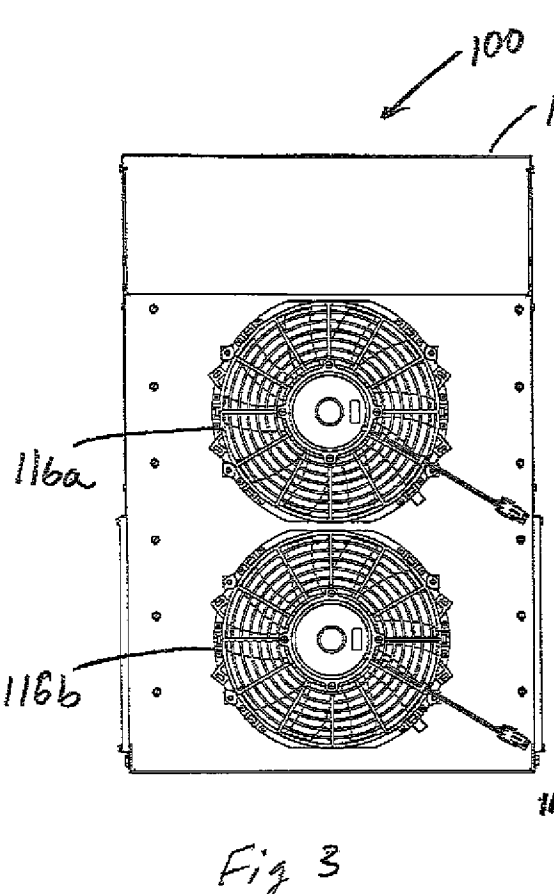
FIG. 3 is a front view of the wall mounted climate control system of FIG. 1.
Figure 2:
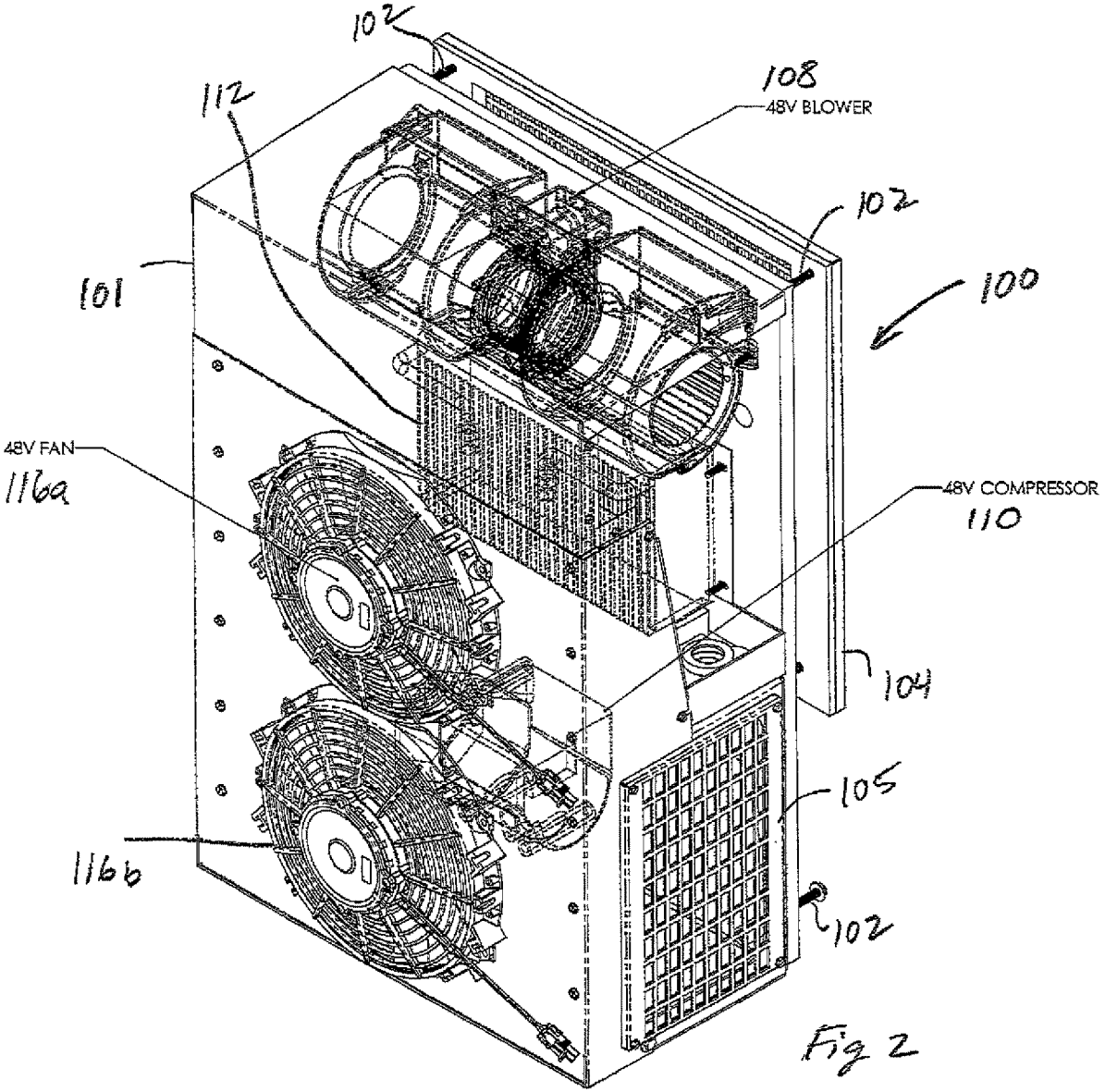
FIG. 2 is a detailed cut-away front perspective view of the wall mounted climate control system of FIG. 1.
Figure 5:
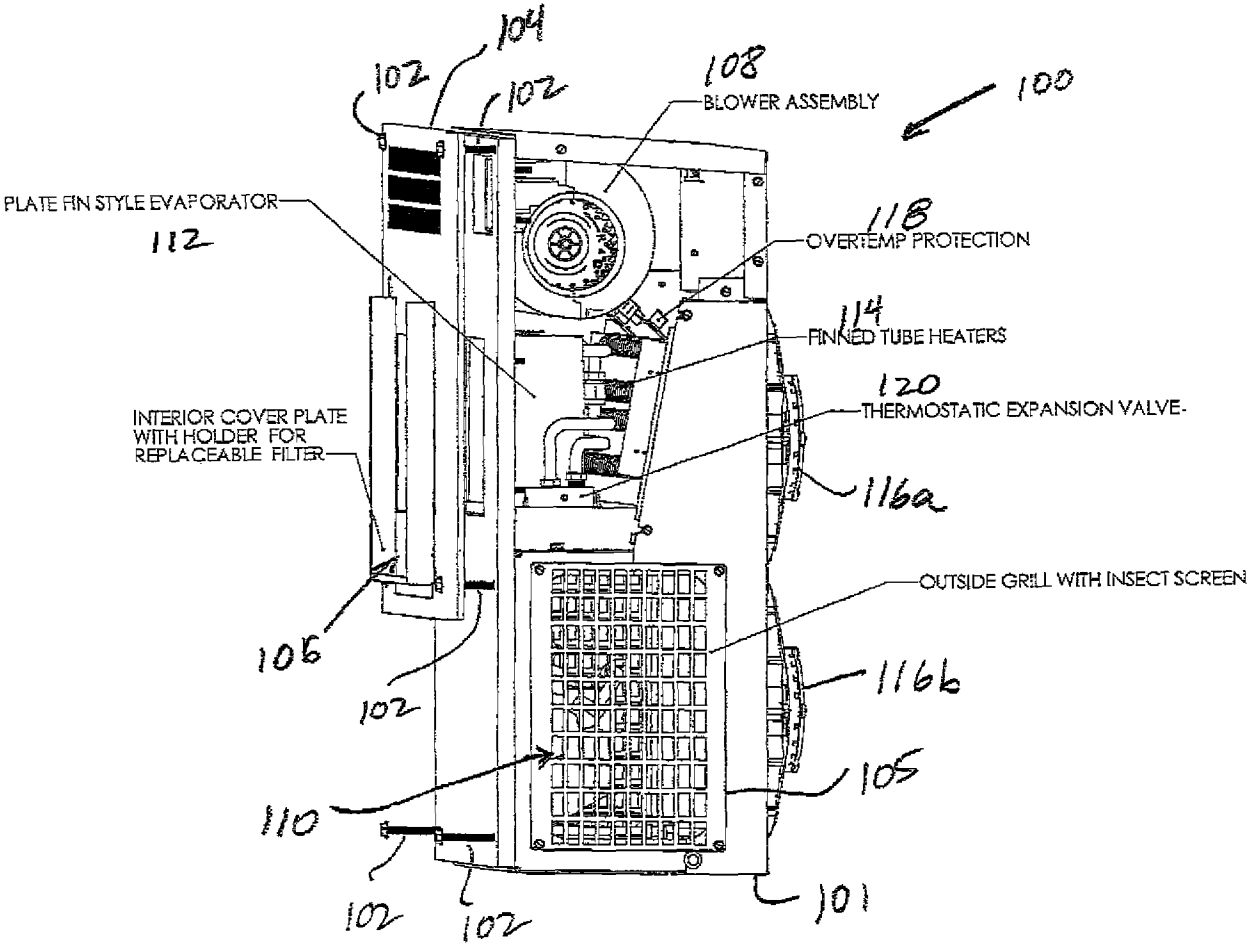
FIG. 5 is a left side perspective view of the wall mounted climate control system of FIG. 1.
Figure 6:
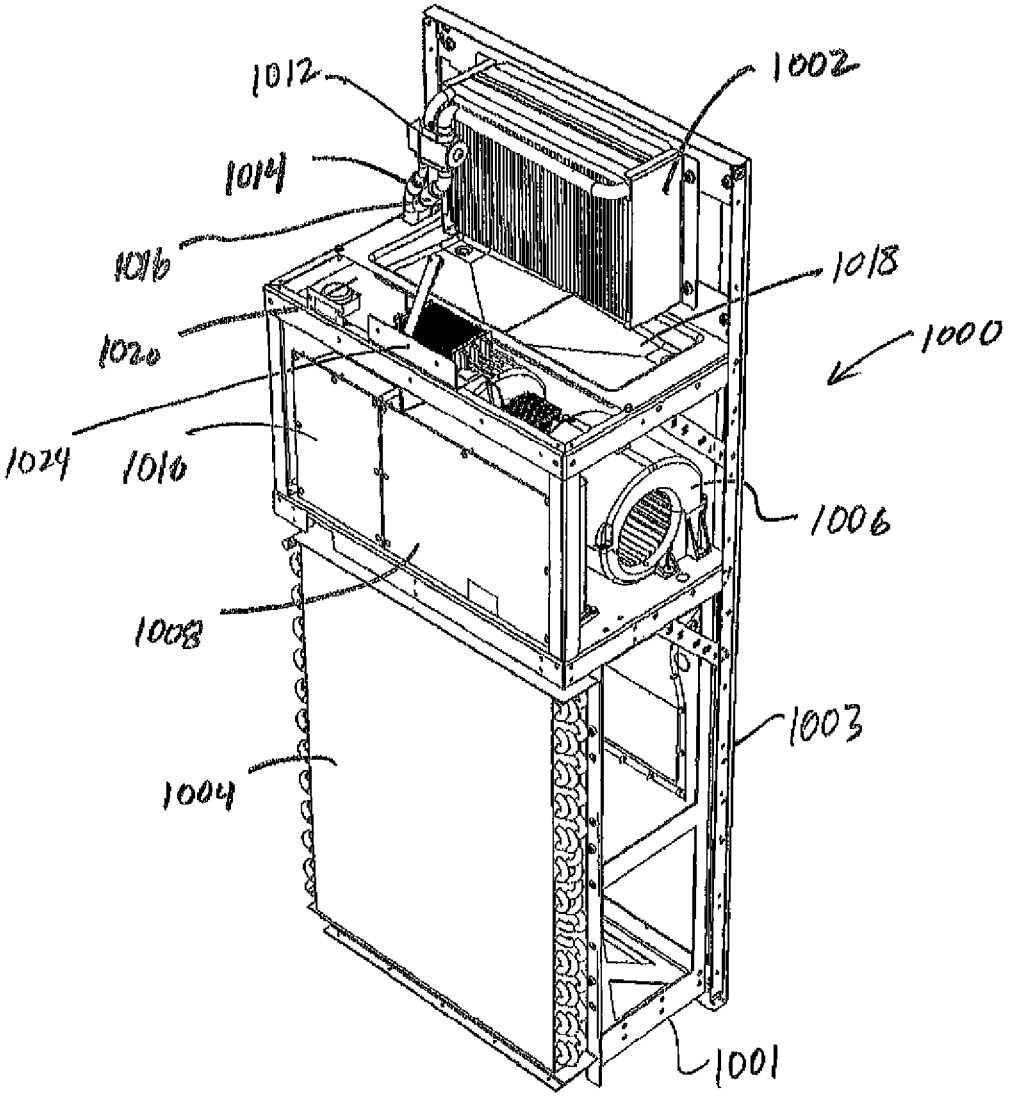
FIG. 6 is a front perspective view of a wall mounted HVAC system according to a preferred embodiment of the present application.
Figure 7:
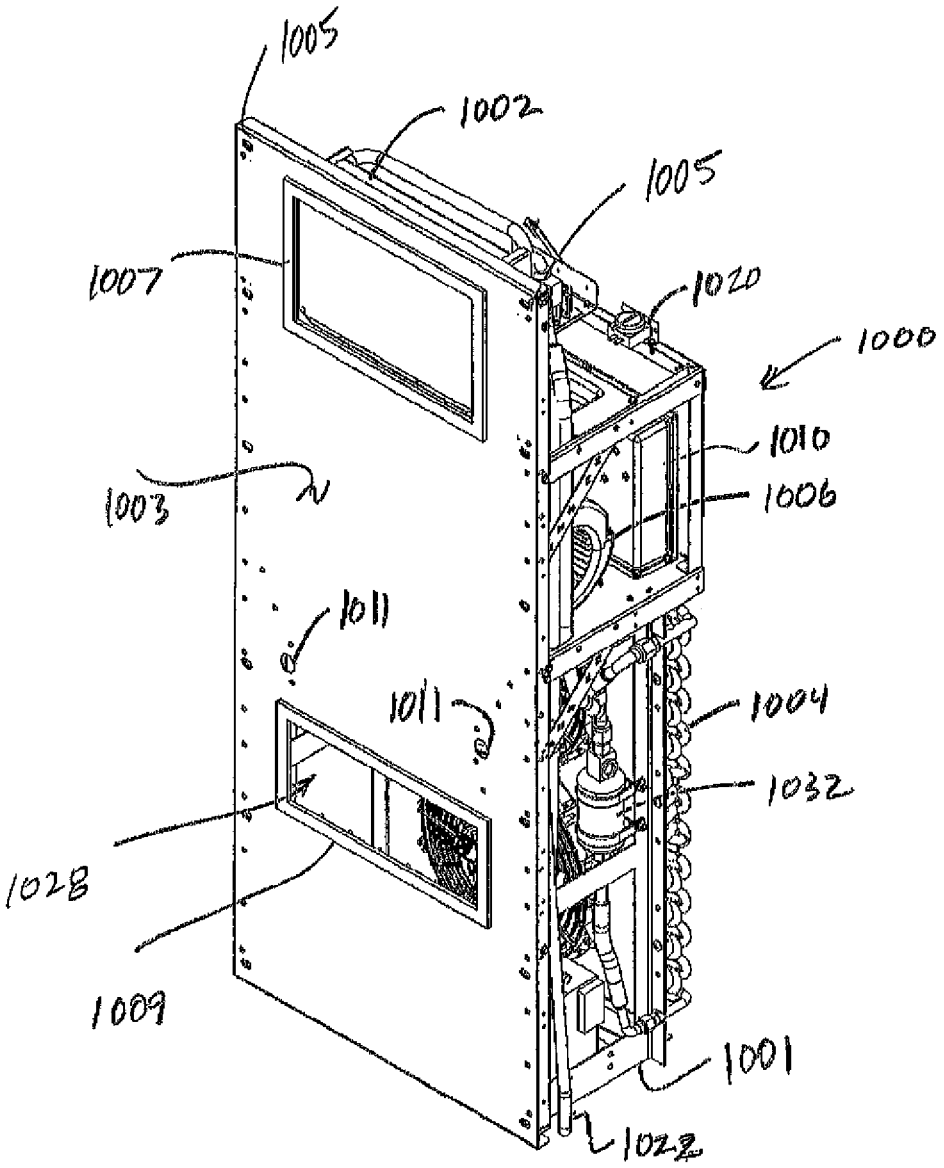
FIG. 7 is a rear perspective view of the wall mounted HVAC system of FIG. 6.
Figure 8:
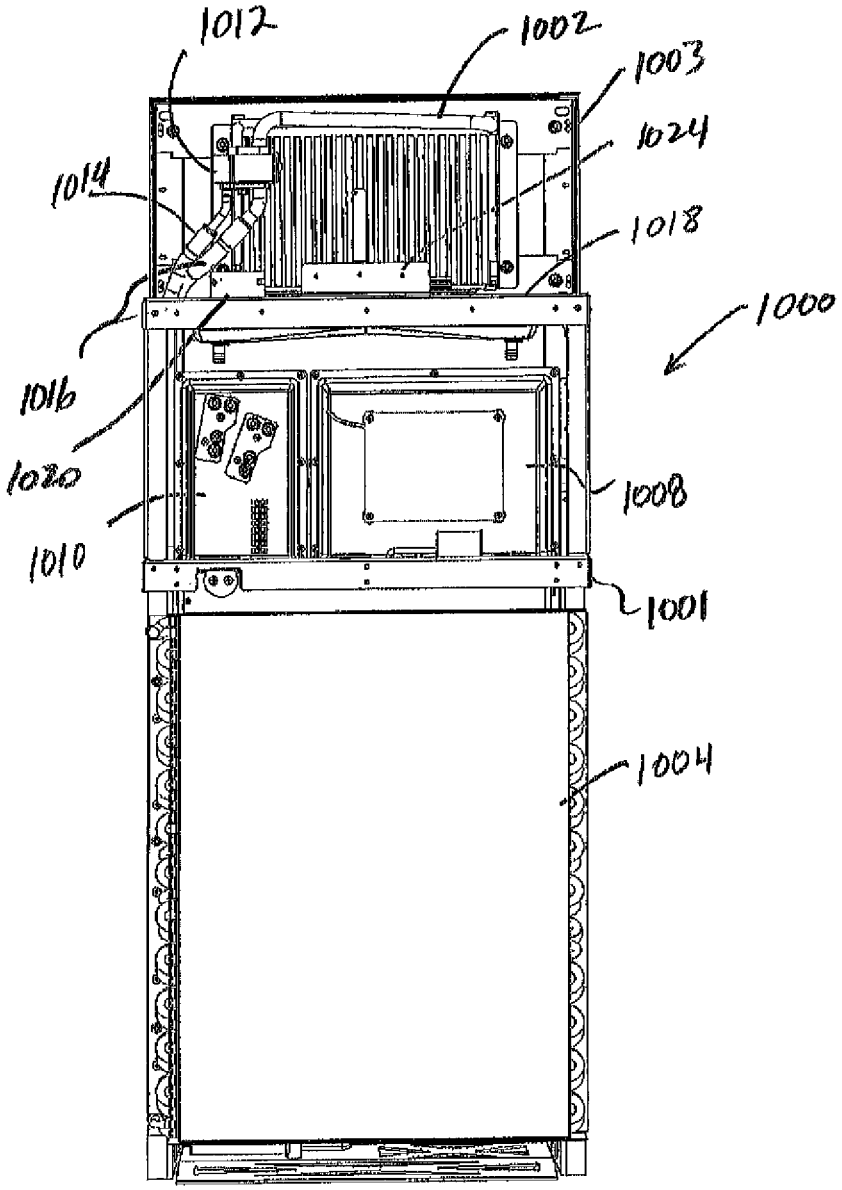
FIG. 8 is a front view of the HVAC system of FIG. 6.
Figure 9:
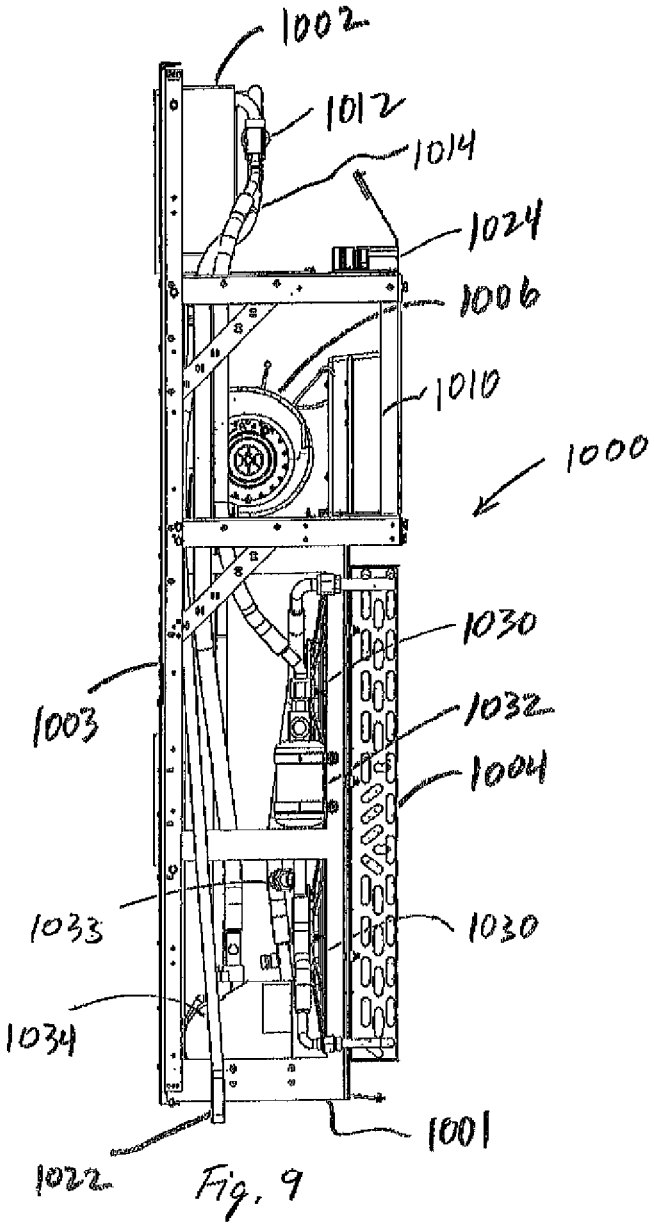
FIG. 9 is a left side view of the HVAC system of FIG. 6.
Figure 10:
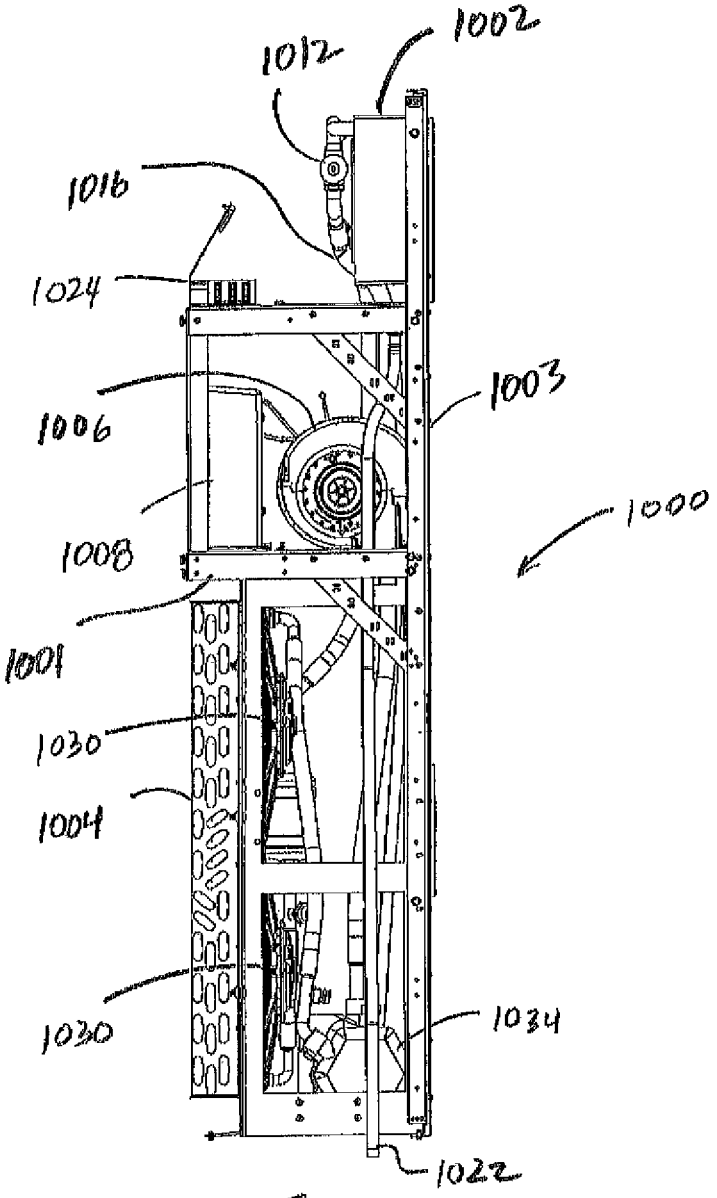
FIG. 10 is a right side view of the HVAC system of FIG. 6.
Figure 11:
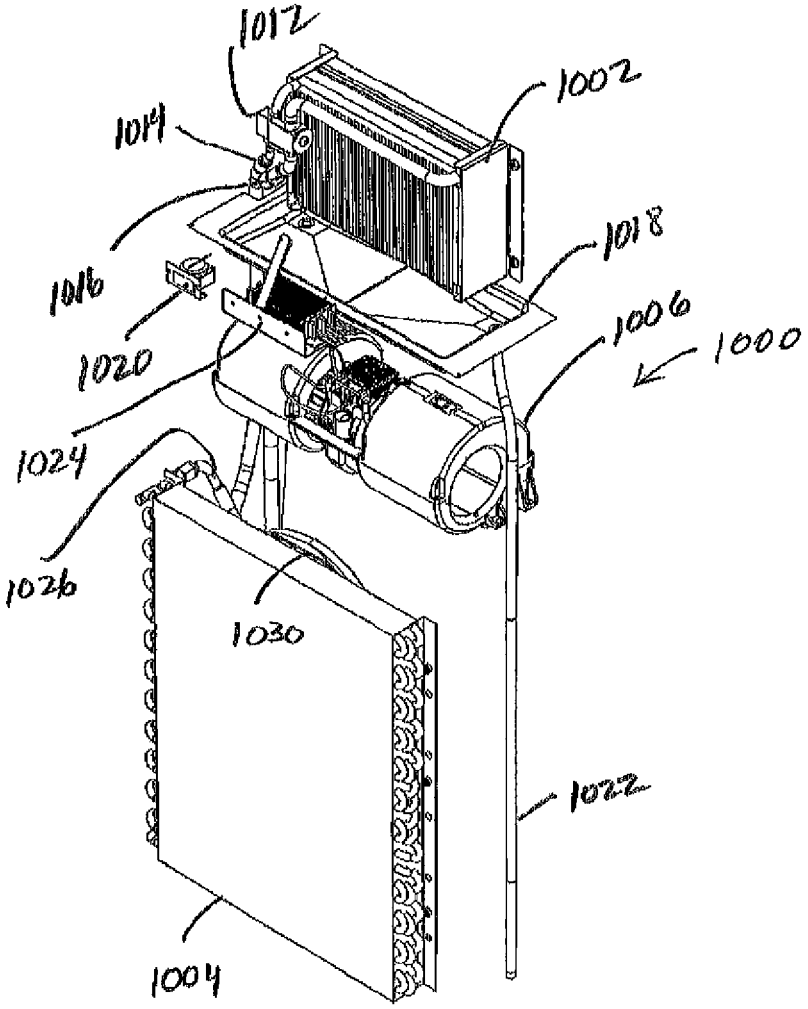
FIG. 11 is a front perspective, partially assembled, view of the HVAC system of FIG. 6, primarily showing the HVAC systems.
Figure 12:
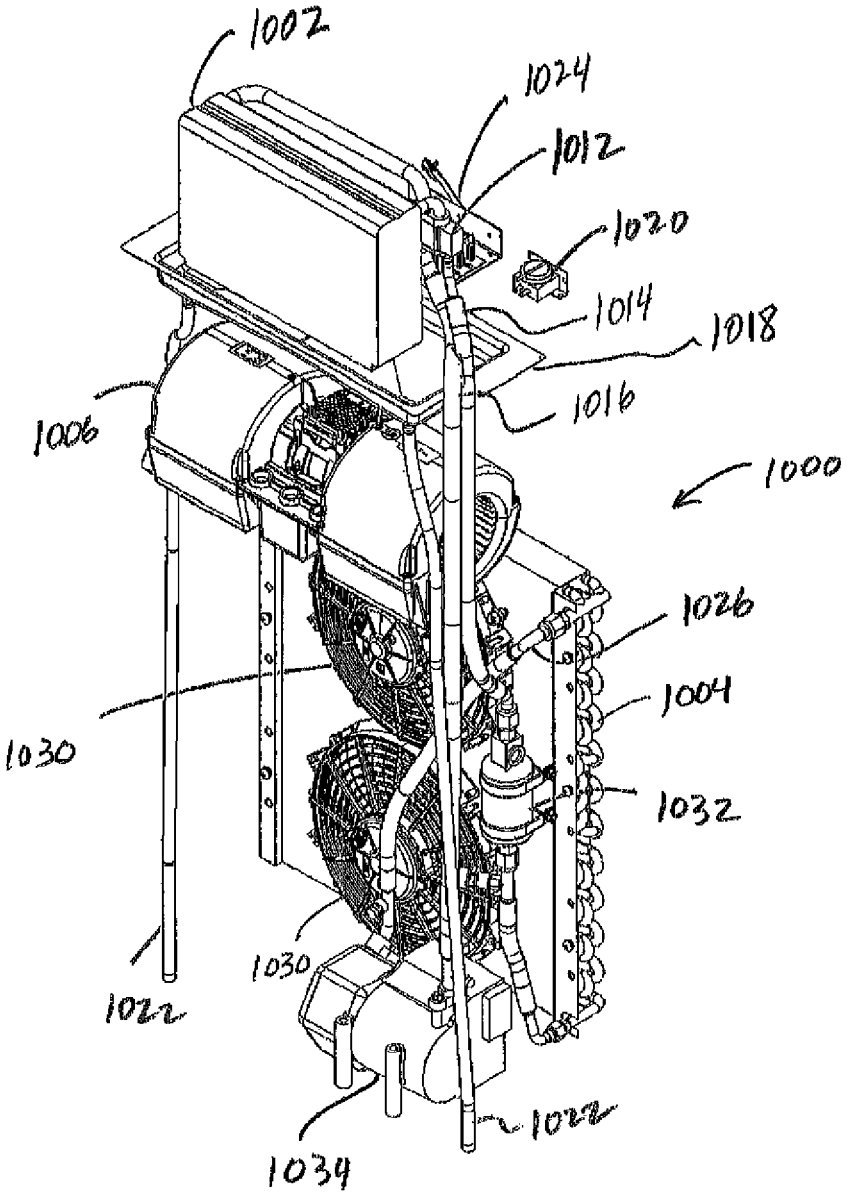
FIG. 12 is a rear perspective, partially assembled, view of the HVAC system of FIG. 6, primarily showing the HVAC systems.
Figure 13:
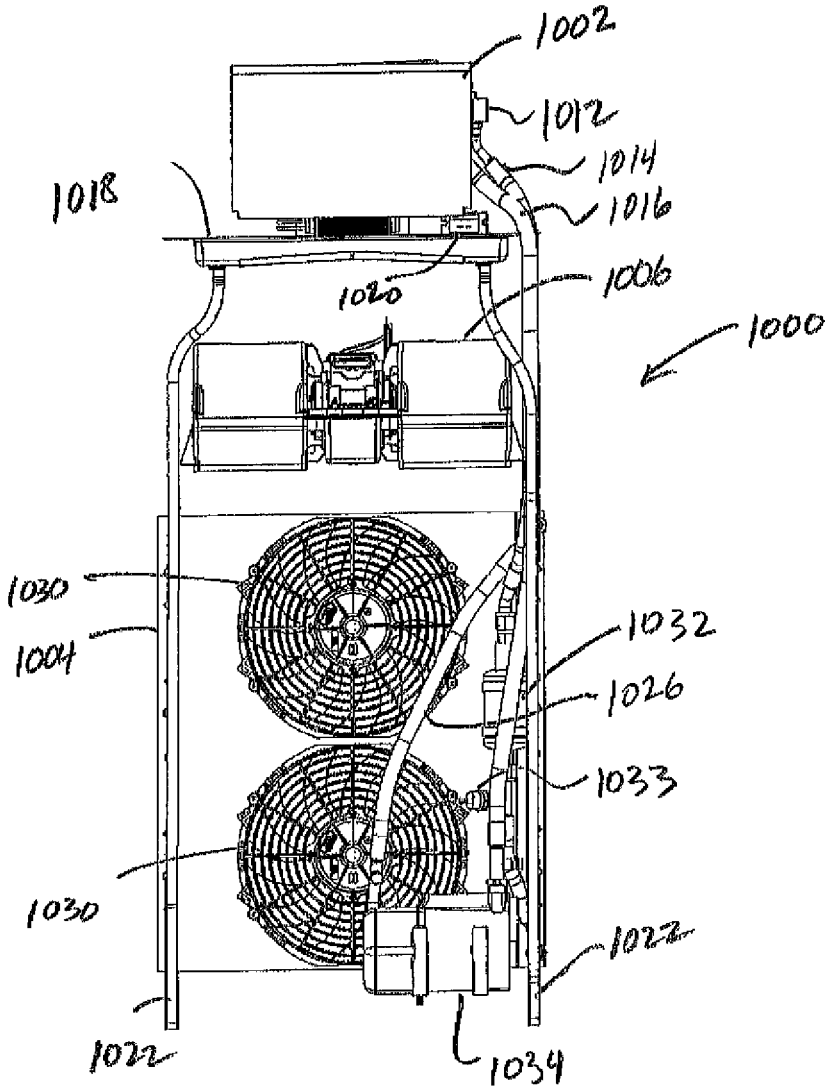
FIG. 13 is a rear, partially assembled, view of the HVAC system of FIG. 6, primarily showing the HVAC systems.
Figure 14:
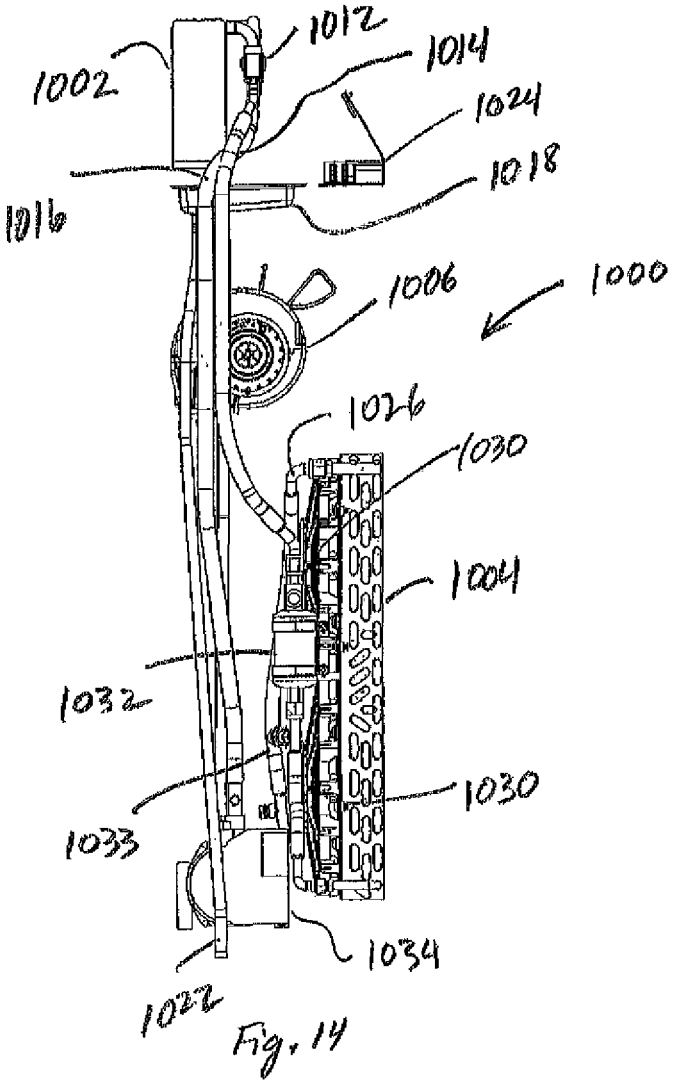
FIG. 14 is a left side, partially assembled, view of the HVAC system of FIG. 6, primarily showing the HVAC systems.
Figure 15:
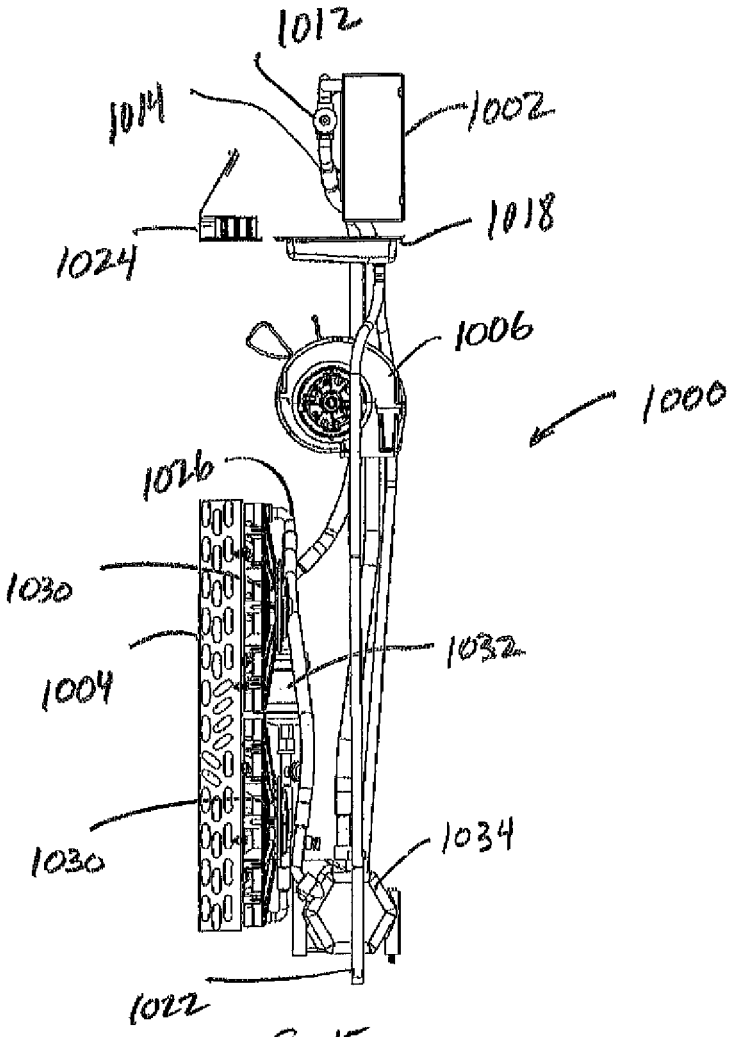
FIG. 15 is a right side, partially assembled, view of the HVAC system of FIG. 6, primarily showing the HVAC systems.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined herein and by any appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

Referring now to FIG. 1 in the drawings, a wall mounted climate control system 100 is illustrated. In this embodiment, system 100 is an electrical system and is configured to run on 48 Volt DC battery power. System 100 is particularly well suited to control the climate and air temperature inside small structures used to house telephony equipment. It will be appreciated that system 100 may be used with a wide variety of structures.

System 100 is configured to be a standalone air conditioning system for use on structures without power available from generator or normal electrical grids. For example, system 100 might be installed on a telephone data center building on a remote mountain top in Colorado, in which the building has its own solar charging and battery storage. In the preferred embodiment, power from 48 Volt batteries, a solar system, and/or other power sources, exist in the structure.

System 100 includes a housing 101 and is configured to mount on the exterior of an existing structure using metal studs 102. Housing 101 is held in place with an internal cosmetic panel 104 that incorporates a removable and replaceable air filter (not shown). The air filter is held in place by a holder 106. Housing 101 includes one or more external vents with grills 105, each grill 105 having an insect screen.

System 100 further includes a 48 Volt DC electric compressor 110, an aluminum plate fin evaporator coil 112, a large face area tube fin condenser coil 114, and a 48 Volt DC dual blower system 108. Compressor 110 preferably includes a soft-start operation subsystem, which reduces in rush current when starting up. Evaporator coil 112 provides for maximum heat transfer of refrigerant to air. Condenser coil 114 reduces overall operating pressures. Large condenser air inlet grills 105 with insect screens prevent pest and nuisance power interruption. Dual blower system 108 provides sufficient airflow to maintain interior temperatures when called upon for operation. System 100 also includes two 48 Volt DC fans 116*a* and 116*b* that operate in parallel to provide redundant air flow for operation of condenser coil 114.

System 100 further includes an over-temperature protection system 118 and a thermostatic expansion valve 120. System 100 includes an alarm system, which produces an output signal in the event of operation error. The alarm system and other control system features may interface with customer standard service call procedures. System may be controlled manually at a control panel connected to system 100, or may controlled remotely by a variety of wired and/or wireless devices and networks.

System 100 may include a heating subsystem to provide heat to the enclosure.

System 100 is an improvement over existing products of similar size and capacity in at least the following categories: greater air flow for faster temperature pull-down; larger evaporator coil with higher capacity; and greater condensing capacity (dual condenser fans instead of one).

Referring now to FIGS. 6-15 in the drawings, a wall mounted heating, ventilation, and air conditioning (HVAC) system 1000 according to the preferred embodiment of the present application is illustrated. System 1000 includes separate heating, air conditioning, and ventilations subsystems. System 1000 is preferably a 48 Volt DC system. System 1000 is housed by and carried by a frame support system 1001 and includes a rear panel 1003 that is disposed within the structure being heated and cooled by system 1000. Rear panel 1003 includes multiple mounting apertures 1005, a supply air gasket 1007, a return air gasket 1009, and one or more apertures 1011 for power and control signal entry.

System 1000 includes an evaporator 1002, a condenser 1004, and a dual scroll blower 1006, and a specialized, unique control system 1008. System 1000 also includes a power and control signal termination box 1010, a thermal expansion valve 1012, a thermal expansion valve refrigerant line 1014, a suction refrigerant line 1016, a drain pan 1018, an evaporator freeze thermostat 1020, one or more drain tubes 1022, and a discharge refrigerant line 1026. A return air plenum 1028 is coupled to dual scroll blower 1006 and opens out of rear panel 1003.

In addition, system 1000 includes a positive temperature coefficient (PTC) heating element 1024, PTC heating element is preferably a 48 Volt DC 700 Watt heating element. It will be appreciated that other sizes of DC heating elements, and other types of DC heating elements may be used. System 1000 also includes dual condenser fans 1030, a refrigerant drier/filter 1032, a binary pressure switch 1033 (high and low pressure), and a 48 Volt DC electric refrigerant compressor 1034.

System 1000 includes the following features:

- 36~60 VDC (nominal 48 VDC) operation.
- Aluminum automotive plate-fin evaporator.
- 2.5 ton rated automotive thermal expansion valve with radial O-ring interfaces.
- Automotive style reduced barrier crimped refrigerant hoses.
- Inline axial filter/drier with sight-glass.
- 48 Volt DC nominal 27 cc automotive style electric scroll compressor.
- Oversized copper tube and aluminum bluefin condenser.
- Automotive binary pressure switch (hi and low pressure detection) installed on liquid line for detection of system refrigeration leaks or overpressure.
- Dual automotive 48 VDC condenser fans, derated to reduce noise of operation.
- Dual-scroll 48 VDC evaporator blower.
- 48 VDC 700 W positive thermal coefficient (P.T.C.) heater.
- Automotive style fixed temperature thermostat for preventing evaporator freezing.
- Temperature sensor for detecting loss of blower during PTC heater operation.
- System control board for HVAC compressor, blower, fans, and heater operation in response to customer control signal input. Also provides alarm feedback.
- Ambient temperature detection for mitigating nuisance alarms due to binary pressure switch operation at low temperature, in which a nuisance alarm is any alarm that is triggered unintentionally or mistakenly.
- Alarm system monitors condition of fuses and alerts if a fuse is failed.
- Condensate drain tube(s) contain partial plug to allow operation, but prevent insect intrusion.
- Case framework and building attachment mounts target operation in up to Zone 4 (hurricane and earthquake).
- Customer 48 Volt DC hookup via application specific busbar design.

System 10000 is particularly useful in the following applications:

- Cell or radio tower "radio shacks."
- Small off grid/remote shelters.
- Backyard "play houses" or sheds.
- Generic 48 Volt DC 65 Amp+ applications.
- Windmill generator control cabinets/sheds.
- Low vibration mobile 48 Volt DC.
- High vibration (with additional support) mobile 48 Volt DC. For example, military, e.g. MRAP, etc.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A wall mounted HVAC system, comprising:

a housing configured for attachment to a building structure using at least one metal stud, the housing comprising:

an internal cosmetic panel;

a holder configured to support a replaceable air filter; and at least one external vent;

a 48 Volt DC electric compressor having a soft-start operation subsystem reducing rush current during start up;

an evaporator coil for maximizing heat transfer of refrigerant to air;

a condenser coil; and a 48 Volt DC dual blower system configured to provide sufficient airflow for maintaining interior temperatures;

an over-temperature protection system; and a thermostatic expansion valve;

wherein the wall mounted HVAC system is configured to be a standalone air conditioning system on structures without readily available power from a generator or electrical grid.

* * * * *